United States Patent [19]

Cowan et al.

[11] 4,186,669

[45] Feb. 5, 1980

[54] COAL BURNING PROCESS

[76] Inventors: Frederick C. Cowan, 82 Cove Rd., Oyster Bay, N.Y. 11771; Thomas L. Cowan, 68 Green St., Huntington, N.Y. 11743

[21] Appl. No.: 835,520

[22] Filed: Sep. 22, 1977

[51] Int. Cl.[2] ..... F23K 1/04

[52] U.S. Cl. ..... 110/347; 110/229; 110/106; 110/306; 110/260; 48/202

[58] Field of Search ..... 110/106, 229, 344, 347, 110/348, 265, 306, 263; 48/202, 210, 197 R

[56] References Cited

U.S. PATENT DOCUMENTS

| | | | |
|---|---|---|---|
| 744,220 | 11/1903 | Neu | 110/260 |
| 2,494,070 | 1/1950 | Thomas | 110/106 |
| 2,623,011 | 12/1952 | Wells | 48/197 R |
| 2,662,816 | 12/1953 | Kalbach | 48/202 |
| 3,229,651 | 1/1966 | Wasp | 110/347 |
| 3,250,236 | 5/1966 | Zelinski | 110/306 |
| 3,446,014 | 5/1969 | Foster-Pegg | 60/39.06 |
| 3,847,563 | 11/1974 | Archer et al. | 48/202 |
| 3,884,649 | 5/1975 | Matthews | 48/202 |
| 3,991,557 | 11/1976 | Donath | 48/203 |

*Primary Examiner*—Henry C. Yuen

*Attorney, Agent, or Firm*—Kirschstein, Kirschstein, Ottinger & Cobrin

[57] ABSTRACT

This process is for devolatilizing coal to produce a volatile hydrocarbon gas leaving a residue of unburned coal. The volatile hydrocarbon gas and other coal or said residual coal are thereafter burned together in a common furnace. The volatilization of the coal may be carried out substantially endothermically, and preferably on the plant site where the burning of the volatilized hydrocarbon takes place together with other coal or the residue coal. The volatile matter is removed from the coal in a volatile state before the residue coal exits from the burner nozzle and then enters the combustion chamber where the volatilized hydrocarbon gas and residue coal are burned together. The removed volatilized hydrocarbon gas can be placed within the same coal burning plant to join with the unburned residual coal, passing to the burner to burn therewith.

12 Claims, 12 Drawing Figures

COAL BURNING PROCESS

This invention relates to process and apparatus for burning of coal.

It has always been a problem to efficiently burn pulverized coal. Among other things, coal consists of volatile matter and carbon. The carbon, although exothermic, needs a high temperature to burn. The volatile matter, also exothermic, burns at a much lower temperature.

If coal is not pulverized, it is usually burned on a grate. This is called stoker burning. Extensive theoretic work has been done on this burning process. Initially the volatile matter is drawn out and burned via natural phenomena to $CO_2$. The drawing out of the volatile gas by its own heat is universal with all coal burning known to date.

The heat of this reaction also partially burns the carbon to an intermediate byproduct of CO gas. Additional air is introduced above this gas to further burn the CO gas to the final product of $CO_2$. This is called suspension burning.

Generally regarded as a more advanced design is a pulverized coal burner used in an open furnace. Here there is a stable flame base where the volatile gas is being drawn out and burns, and a second area where the main carbon is burning. The exact chemical reactions are not relevant but they are akin to that of the stoker method. The secondary air used in these final reactions can either come from directly behind the burner, or from remote locations.

A slightly different version of the above method of pulverized coal burning, called a cyclone furnace, is to confine the whole burning process to a smaller combustion chamber, where secondary air is tangentially introduced well downstream of the initial flame base. This is very analogous to the stoker burning, whereby one forces the coal to be burned with a deficiency of oxygen in order to increase the base temperature. It also has another advantage of using the mechanical energy of the motion of the secondary air to turbulate the mixture of coal and combustion air.

All prior burners can be summarized as follows: As coal enters the flame pattern, the volatile matter within the coal is driven out of the coal by the heat of the flame and burns. The energy from the volatile matter (1) maintains the heat to drive out successive volatile matters as the coal enters the flame pattern and (2) heats the rest of the coal, primarily the carbon, to a temperature such that it will burn further downstream in the flame pattern. Thus the presence and burning of volatile matter is essential to both flame stability and complete coal burning. All coal burners known to date depend on this naturally occurring phenomena of drawing out the volatile matter downstream of the nozzle, within the flame itself, and having the volatile matter perform its stabilizing and combustion role within the flame pattern itself.

I. THE PROBLEM

The aforementioned coal burning methods rely on this natural volatile generation. However, implicit in this design are four problem areas which have been found to be universal with all pulverized coal burners because they depend on this natural volatile generation.

1. FULL LOAD

If all other physical properties are equal because coal particles need more time to burn, and due to the fact that there is a limited amount of time in which combustion must take place, coal burners need a higher amount of excess air to reasonably complete the combustion process than when burning oil or gas. Excess air detracts from a burner's efficiency because of the heat absorbed by the extra air is not fully absorbed in the furnace.

2. TURNDOWN

The physical dimensions of a burner are based on full load characteristics. However, in burning less than the full designed capacity, that is, in "turning down" a burner, the efficiency of any inorganic fuel burner always suffers by requiring more excess air. Also, as a burner is turned down, it tends to become less stable by either having flame outs or developing pulsations. The limit of a burner's turndown via either inefficient operation or instability limits the overall turndown of the equipment that the burner is heating.

On multiple burner boilers, a low turndown ratio necessitates burner shut down.

The turndown problem is particularly significant in a pulverized coal burner because of the need to maintain a large flame base to maintain the natural volatile generation.

3. IGNITION

Since coal burning relies on natural volatile generation, the starting of any coal burner requires an external energy source such as an oil or natural gas ignitor to (1) start pulling out the volatile matter and (2) to start the heating of the carbon in the coal. Thus the ignition energy needed is far in excess of the energy needed to just ignite a volatile combustion mixture. The energy must in fact approximate the amount of energy of the volatile matter that will be generated in the base of the flame.

Thus ignitors to light coal must be large, sometimes 20% of the burner's capability, and create a need for an auxiliary fuel supply.

4. COMPLEX OPERATION

Due to the need to increase a coal burner's turndown and because of the presence of large auxiliary fuel ignitors, a normal operational procedure has evolved where ignitors are used to continuously stabilize coal burners at lower loads. This has created a need for a continuous supply of an auxiliary fuel. In addition, dual fuel burning sometimes has problems of secondary chemical reactions or formation of precipitates between the two fuels.

Because of the large reliance on the ignitors, the burning, maintenance, and safety logic of this secondary fuel is a prime concern in coal burning installations.

II. SOLUTION

Rather than rely on natural volatile gas generation of coal flames, it is herein proposed to (1) remove the volatile matter from the coal in its volatile form before the coal exits from the burner nozzle, that is, before the coal enters the combustion chamber, and (2) place this gas, still in its volatile form, within the same coal burning plant in more strategic locations in order to solve the aforementioned problem, and/or to increase the net plant operation or economic efficiency.

1. REMOVAL

It is proposed to remove any part or all of the volatile matter from coal at any number of strategic locations on the plant site.

A. It can be done at the delivery—storage location before the pulverizer.

B. It can be done immediately at the pulverizers.

C. It can be done on any header or "Accumulator—Storage" after the pulverizers.

D. It can be done at each burner's entry pipe, but before the burner itself.

E. It can be done inside of each burner, but before it exits from the nozzle throat.

2. PLACEMENT OF VOLATILE GAS

Many strategic locations and uses are possible for solving the aforementioned problems.

A. If as a result of solving the aforementioned problems, there is an excess of volatile gas available such that all of it is not necessary for coal burning, then it might be more economical to sell or use the volatile gas for non-on site combustion uses. For instance, one could use it in chemical processing either on site or sell it for off site use, or it could be sold for domestic burning.

B. In order to solve the aforementioned problems, the following utilizations of the removed volatile gas is proposed.

(1) To store the gas for any future purpose.

(2) To be burned as a fuel directly in a burner compartment. For instance one might burn the volatile gas in the lower burner and burn the coal or partially devolatilized coal in an upper compartment.

(3) To use the volatile gas for an ignitor. The volatile matter used as a side gas ignitor for the partially devolatilized coal.

(4) To place a ring of volatile gas around the main coal burner.

(5) To place or introduce the volatile gas as a distinct jet in the middle of the coal pattern.

(6) To introduce the volatile gas as a mixture with any other fuel including coal. Note that in this instance the gas, although mixed with the coal, is not burned and is distinctly isolated such that it is ready for ignition and does not have to be drawn out in the flame pattern. It can be inserted in any of the following locations.

(a) In the gun.

(b) In the burner pipe.

(c) In the coal header.

(d) At the pulverizer.

(7) To use volatile gas in any other location that might aid to the solution of the aforementioned problems.

3. COMBINATION

A. Any combination of removal and placement of volatile gas. For instance, one might place a volatile generation in the pulverizer or directly in the burner gun. Note that in neither of these cases is the gas necessarily removed from the coal stream, but rather is processed in the coal line itself.

B. To vary the amount of volatile gas as operations dictate. For instance, at lower loads one might increase the amount of volatile matter removed. Or alternatively the amount of volatile matter removed might remain constant over loads, but at higher loads less might be needed and therefore less used; the excess could be stored or used in other parts of the plant.

III. ADDITIONAL NOTES

The present process is distinct from the natural volatile gas generation normally used based on but not excluding the following points:

1. We will operate on the coal before it enters the combustion chamber.
2. We will remove the gas, in its basically unaltered hydrocarbon form. Although there might be some minimum chemical changes of this gas when it breaks away from the carbon, these changes will represent the mininum amount necessary to be a free and distinct component of the coal.
3. The removal of the volatile gas will basically be an endothermic reaction. Although there might be some heat generating reactions occurring in the process of removal and it is conceivable that this energy will be self sustaining to pull out more volatile gas, the desired product would be volatile gas and not the by-products or partial by-products of the volatile gas. For instance, we do not wish to exclude a volatile gas generator that uses the heat of its own burnable coal to drive out the volatile gas and separate this gas from the solids if the gaseous by-products still was the usable, storable and burnable volatile gas from the coal.
4. Separating the coal and volatile gas entails leaving the carbon part of the coal unaltered. Although some trace reactions are conceivable, such a reaction would be irrelevant to the desired process claimed.
5. If we may call "volatile gas" any gaseous hydrocarbon (CnHm) that is produced from coal and used in the matter mentioned, then this would entail possible reactions between the loosely bound volatile gas and the carbon. It would also entail new forms of hydrocarbons (CnHm) made in the process of removing the volatile gas. It would preclude us from partially burning coal to form CO gas (which is burnable) but not exclude us from using the coals own heat to generate the far more volatile and desirable hydrocarbon gas.

Prior art: U.S. Pat. No. 3,727,562, William Valentine Bauer, For THREE STAGE COMBUSTION.

An object of this invention is to provide a relatively inexpensive apparatus and process of the character described which shall be highly efficient and relatively simple.

Other objects of this invention will in part be obvious and in part hereinafter pointed out.

The invention accordingly consists in the process steps which will be exemplified in the process hereinafter described and of which the scope of invention will be indicated in the following claims.

IN THE DRAWINGS

Figure 1:
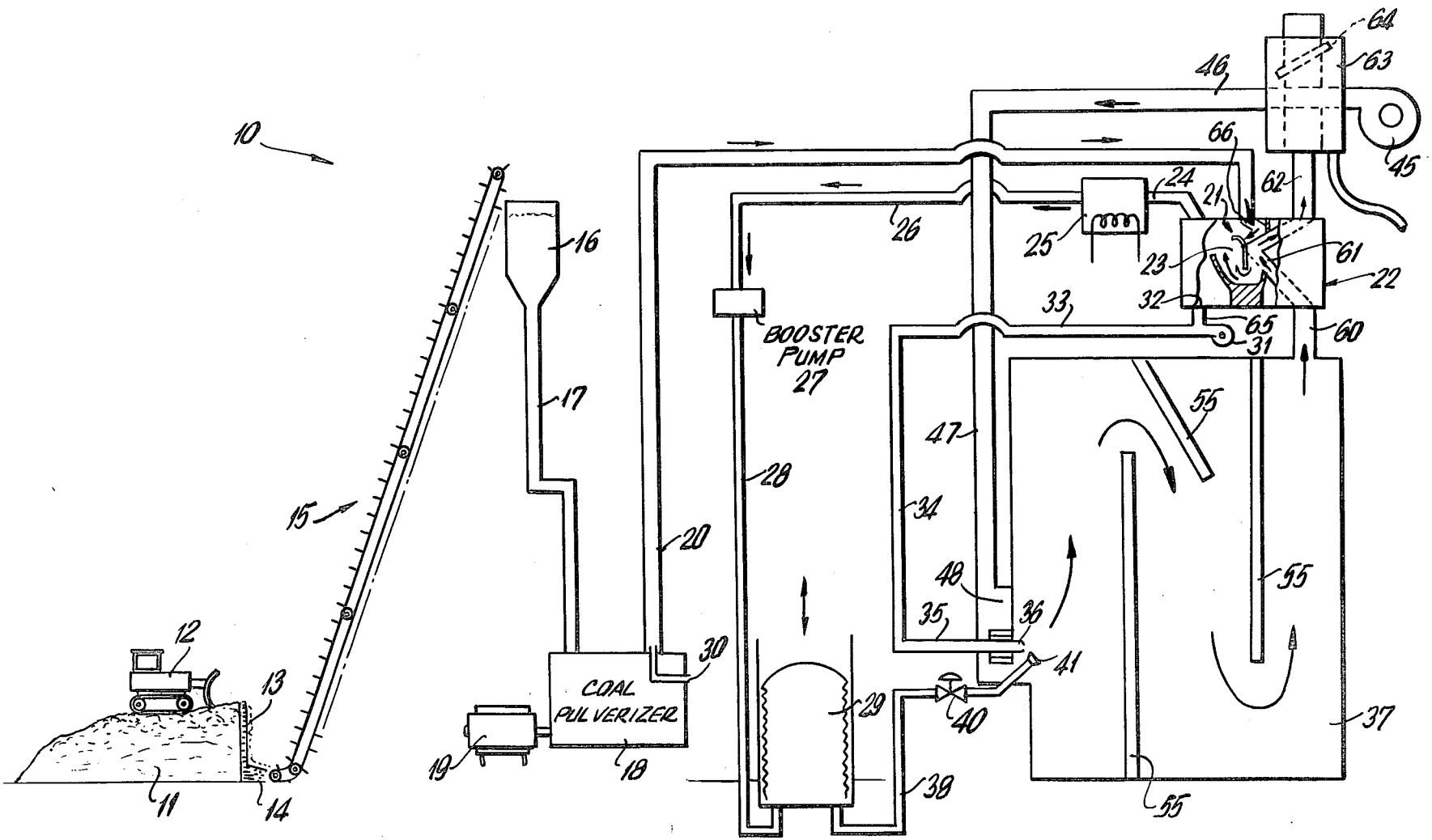
FIG. 1 is a schematic view of apparatus for carrying out the process embodying the invention.

Referring now in detail to the drawing and particularly to FIG. 1, numeral 10 designates apparatus for carrying out the inventive process. Said apparatus comprises a coal storage 11 from which a tractor 12 can move coal to a chute 13 having an outlet 14 at its lower end opening to the right (looking at FIG. 1). Coal coming out of the outlet 14 is carried by a coal conveyor belt 15 upwardly at an incline to drop the coal into the upper open end of a coal bunker 16. The lower end of the coal bunker is connected by a downwardly extending pipe 17 to a coal pulverizer 18 which may be actuated by a suitable motor 19. The pulverizer 18 is connected by a pipe 20 to a heat exchanger 21 in a volatile gas separator 22. The heat exchanger includes an upwardly curved passage 23 opening upwardly within the separator 22. The separator is connected by a pipe 24 connected to a heat exchanger 25. The heat exchanger 25 is connected by pipe 26 to a booster pump 27 for gas. The booster pump is connected by pipe 28 to a volatile gas storage 29.

Steam may be fed to a pipe 30 which passes into the coal pulverizer and leads to the lower end of pipe 20 and used as a coal dust pump to blow coal from the pulverizer 18 up pipe 20 to the volatile gas separator 22. Also, air blower 31 is employed to withdraw residue coal from outlet 32 of the separator 22 to blow residue coal through pipes 33, 34, 35 into a coal gun 36 projecting into fire box 37. Volatile hydrocarbon gas from storage 29 can pass through pipe 38 controlled by a gas valve 40 connected to an ignitor gun 41 positioned to ignite the burner gun 36 for heating up the fire box. This ignitor can be fed with hydrocarbon gas continuously.

Air from a fan 45 blows through pipes 46 and 47 to a burner register 48 to supply air for burning the coal dust issuing from gun 36, within the fire box.

Oxygen may be excluded from the separator 22.

Boiler water tubes 55 project into the fire box 37 to absorb energy from the burning coal and volatile hydrocarbon gas in the fire box 37.

The volatile gas separator 22 can be heated by hot flue gases going from the upper end of fire box 37 to a pipe 60 entering the separator. Pipe 60 connects to a radiation type grill pipe 61 passing in front of pipe 21 and gas passes up through pipe 61 out of the separator and goes through pipe 62 to a combustion air heat exchanger 63 and soot collector 64. The separator 22 serves to separate volatile hydrocarbon gases from the coal. The separated or devolatilized coal is pulled down through pipe 65 to said pipe 33 and is blown by air from fan 31 through pipes 33, 34, 35 to the coal gun 36. The steam from pipe 30 blows the pulverized coal up through pipe 20 to the top of the separator at 66 to the place where the coal is devolatilized substantially endothermically.

Figure 2:
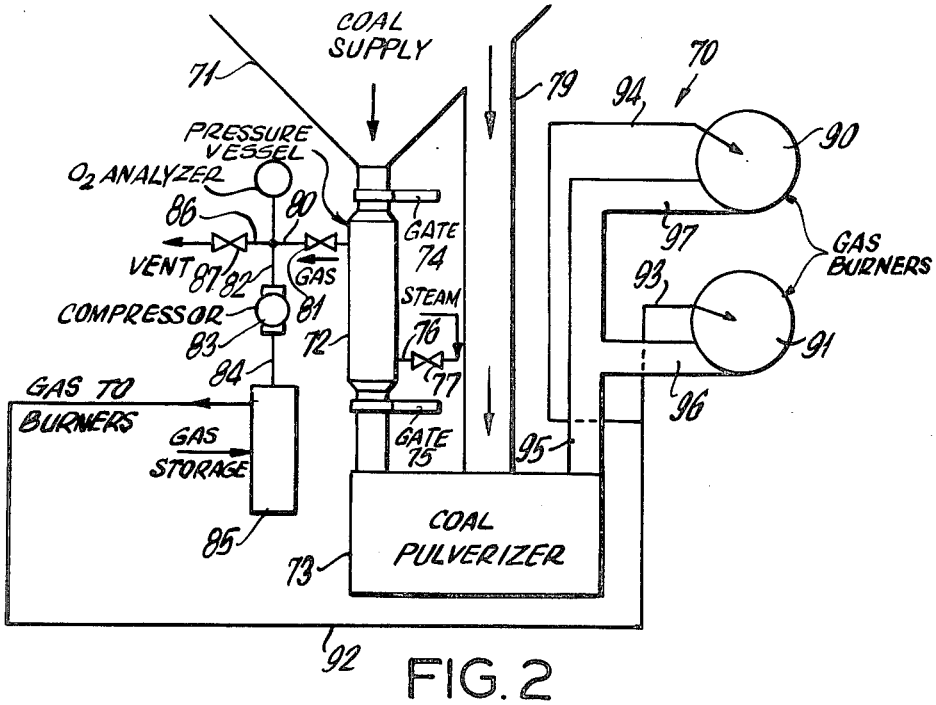
FIG. 2 is a schematic view of a modified apparatus for carrying out the invention.

In FIG. 2 there is shown another apparatus 70 for carrying out the inventive process. Said apparatus 70 comprises a coal supply hopper 71 through which coal passes down to a devolatilizer 72 to a coal pulverizer 73. Between the hopper 71 and devolatilizer 72 is a gate 74. Between the devolatilizer 72 and the pulverizer is a gate 75.

Steam is fed to the devolatilizer through pipe 76 controlled by a valve 77. A separate conduit 79 may carry coal from hopper 71 directly to the pulverizer.

Volatile hydrocarbon gas extracted endothermically from the coal by the steam may pass through pipe 80 controlled by valve 81. From pipe 80 the volatile gas may pass through pipe 82 to a compressor 83 and from compressor 83 through pipe 84 to a gas storage 85.

Pipe 82 may be connected to a vent pipe 86 controlled by a valve 87.

The apparatus 70 also includes gas burners 90, 91. Gas from gas storage 85 may pass through pipe 92 to a pipe 93 to the gas burner 91, and simultaneously to a pipe 94 to gas burner 90.

Pulverized coal is passed from the coal pulverizer 73 through pipe 95 to a pipe 96 leading to the burner 91 and to a pipe 97 to the burner 90. Thus the volatile gas extracted from the coal endothermically is burned together with the residue coal (and undevolatilized coal from the hopper), in burners 90, 91.

Figure 3:
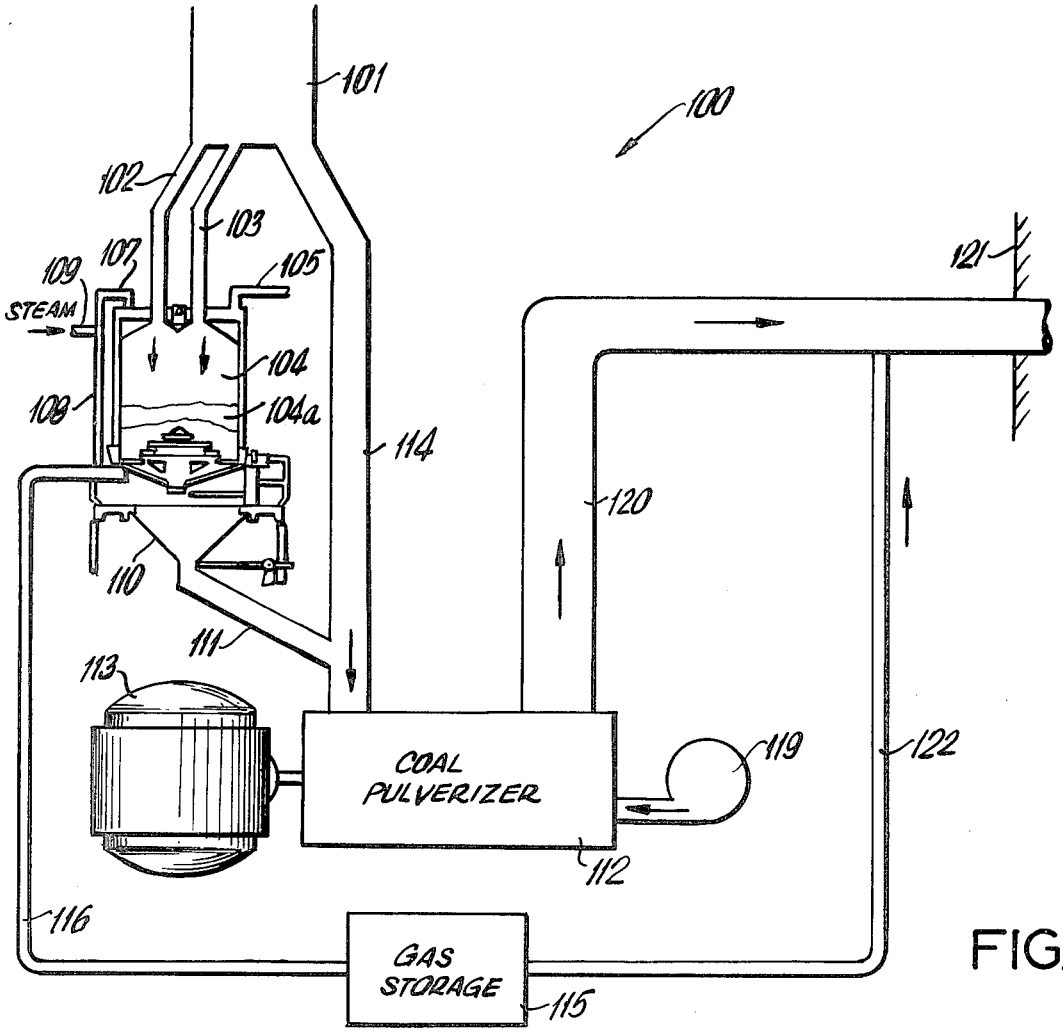
FIG. 3 is a schematic view of another form of apparatus for carrying out the invention.

In FIG. 3 there is shown still another apparatus 100 for carrying out the inventive process, but in which the coal during volatilization is partially burnt, but yet leaving unburned coal.

Apparatus 100 comprises a coal bin 101 connected by a pair of chutes 102, 103 to a chamber 104. Limited air is fed to the chamber 104 through conduit 105 so that some combustion takes place at zone **104*a* in chamber 104, but still leaving a substantial portion of the coal unburned. Volatile gas passes out of chamber 104 through pipe 107, 108. Steam may enter the chamber 104 through pipe 109 connected to pipe 108. Residue partially unburned coal passes down from chamber 104 through funnel 110 and pipe 111 to a coal pulverizer 112 operated by a motor 113. Coal from the bin 101 may also pass directly to the pulverizer through another conduit 114**.

Volatile hydrocarbon gas created in chamber 104 passes to a pipe 116 connected to the lower end of pipe 108, to a gas storage 115. Pulverized coal, including coal residue from the devolatilizing process is blown by a blower 119 through pipe 120 to a fire box 121. Gas from the storage tank 115 passes through pipe 122 which connects to pipe 120 before the coal in said pipe 120 reaches the fire box. Thus the carbon gas and coal including coal residue from the devolatilization process are burned together in the fire box 121.

Figure 4:
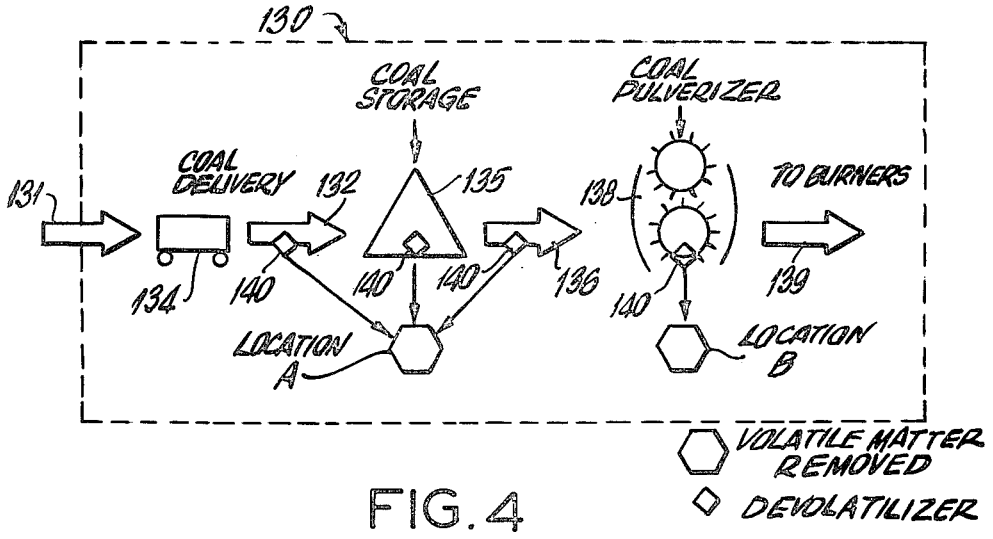
FIG. 4 illustrates a further form of apparatus for carrying out the inventive process.

In FIG. 4 there is illustrated apparatus 130 in which coal is delivered in the direction of arrows 131, 132 by a car 134 to a coal storage 135 and from coal storage 135 in the direction of arrow 136 to a pulverizer 138, from which the pulverized coal moves in direction of arrow 139 to burners. The small diamonds (on FIG. 4) 140, indicate points at which the coal in car 134 can be devolatilized, before storage, and/or in storage, and/or after storage, and/or in the pulverizer. The volatile hydrocarbon gas resulting from the devolatilization may be removed to locations A and B, indicated by the hexagonals in FIG. 4, at locations A and B. The removed hudrocarbon gas can then be burned in an ignitor, with any other coal or it can be fed to the residue coal after devolatilization, but before the coal is burned, so that the hydrocarbon gas is burned together with the coal residue.

Figure 5:
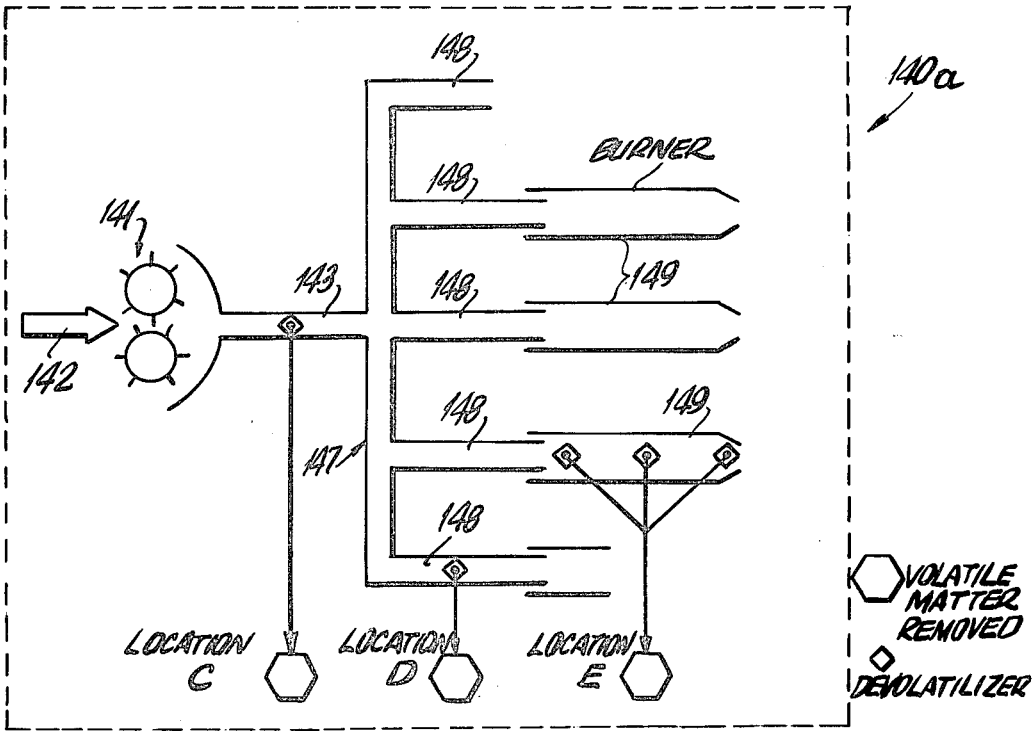
FIG. 5 illustrates a still further form of such apparatus.

In FIG. 5, the apparatus **140*a* comprises a coal pulverizer 141. Coal is fed to the pulverizer in direction of the arrow 142. From the pulverizer, the coal is fed through a pipe 143 to a header 147 to various pipes 148** to coal burners 149. Devolatilization of the coal can take place in pipe 143, pipe 148 or burners 149. Volatile gas resulting from devolatilization can be removed to locations C, D or E in FIG. 4. The volatile gases can then be fed to the residue coal prior to exit of the coal to the fire box.

Figure 6:
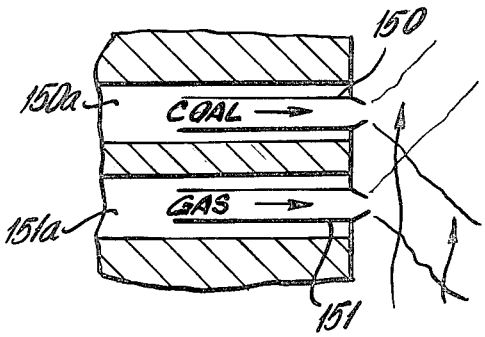
FIG. 6 illustrates apparatus of a further modified form to accomplish the inventive process.

In FIG. 6 there is shown a coal burner pipe 150 receiving coal and a gas supply pipe 151. These pipes 150, 151 are parallel and are located in passages 150*a*, 151*a*. In this case both the pipes 150, 151 have their outlet ends at the fire box of the furnace or burner compartment. The coal may be unburned coal, a residue of devolatilization of coal.

Figure 7:
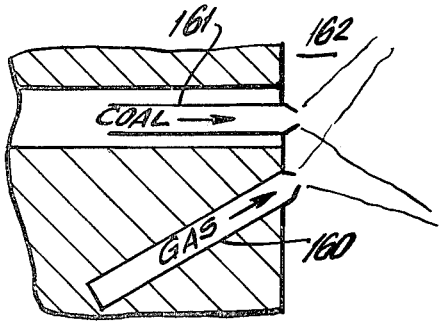
FIG. 7 illustrates a further modification of FIG. 6.

In FIG. 7, the volatile hydrocarbon gas is fed to an ignitor 160 to ignite coal residue from pipe 161, which burns in the burner compartment 162. The ignitor can be fed hydrocarbon gas continuously.

Figure 8:
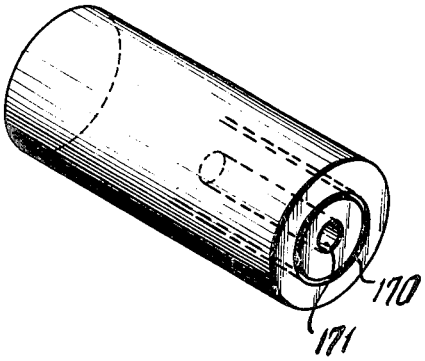
FIGS. 8, 9, 10, 11 and 12 illustrate further modifications of the apparatus.

In FIG. 8 the apparatus shown comprises means to place a ring 170 of volatile hydrocarbon gas around a central coextensive main coal burner 171, so that both the coal and gas burn together. The coal can be residue unburned left from devolatilization.

Figure 9:
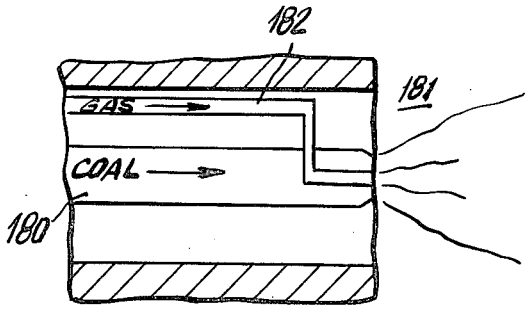

In FIG. 9 residue coal is fed through a central or axial pipe 180 to a burner compartment 181. Volatile hydrocarbon gas passes through pipe 182 to the inside of pipe 180 and both burn together in a fire box or furnace, because the outlets of pipes 180, 182 are at the furnace or fire box compartment 181.

Figure 10:
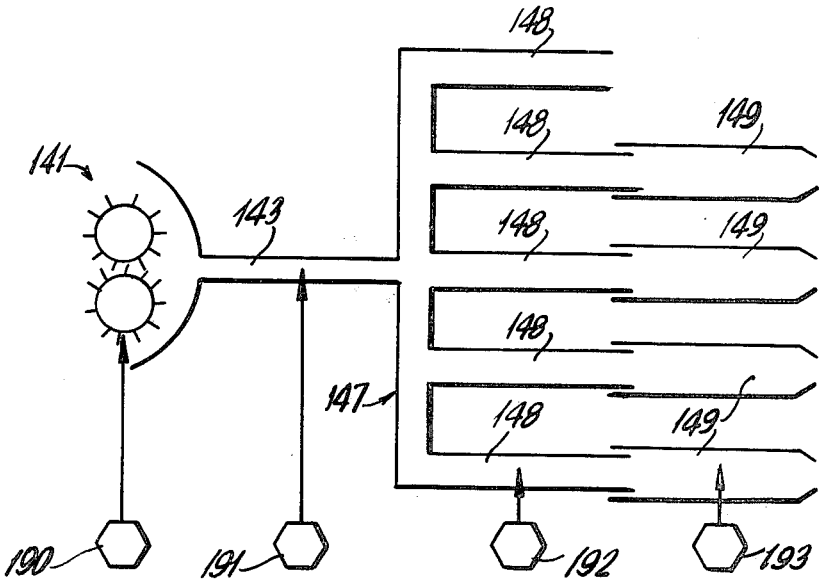

FIG. 10 is same as FIG. 5 except that volatile hydrocarbon gas produced by volatilization can be fed to the pulverizer as indicated at 190, or to the pipe 143 as indicated at 191, to one or more pipes 148, as indicated at 192, or to coal guns 149, as indicated at 193. The gas generated can then flow with the residue coal stream to the burners.

Figure 11:
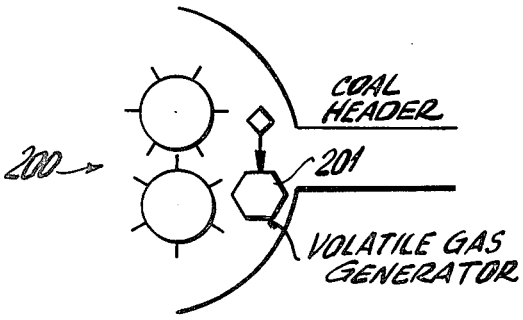

In FIG. 11, the devolatilization may take place within the pulverizer 200 as indicated at 201 and the resulting volatile hydrocarbon gas joins the coal stream at the pulverizer and flows with the coal to the burner where the gas and residue coal burn together.

Figure 12:
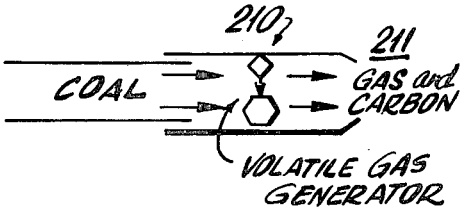

FIG. 12 shows the devolatilization to take place in the coal burner, as at 210, and the gas and residue coal flow together to burn in the furnace chamber 211.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

We claim:

1. A process combining, within a plant boundary, obtaining a volatile hydrocarbon gas from coal in the absence of a combustion supporting atmosphere by devolatilizing coal in a noncombustible atmosphere, leaving residue unburned coal, forming the volatile hydrocarbon gas obtained by devolatilization of coal as a stream physically separate from the unburned devolatilized coal, and thereafter burning at last some of said hydrocarbon gas in a main burner flame together and in physical contact with coal in a common furnace in a combustion supporting atmosphere, the physically separate stream of volatile hydrocarbon gas generated within the plant boundary constituting an auxiliary stream for assisting the main burner flame.

2. The process of claim 1, in which the volatilization of the coal is carried out substantially endothermically.

3. The process of claim 1, wherein the coal burned together with said hydrocarbon gas is burned in the same furnace and is residue unburned coal remaining from said devolatilization.

4. The process of claim 1, wherein the devolatilization of the coal takes place on site with the burning of the hydrocarbon gas together with coal.

5. The process of claim 4, wherein the coal burned together with said hydrocarbon gas is burned in the same furnace and is residue unburned coal remaining from said devolatilization.

6. The process of claim 1 wherein the coal being devolatilized is pulverized coal.

7. The process of claim 6, wherein the coal burned together with said hydrocarbon gas is burned in the same furnace and is residue unburned coal remaining from said devolatilization.

8. The process of claim 6, in which the coal is pulverized before the coal is devolatilized.

9. The process of claim 6, wherein the coal is pulverized after devolatilization.

10. The process of claim 9, in which the residue unburned coal and volatile hydrocarbon gas are burned together after pulverization of the coal.

11. The process of claim 1, in which the auxiliary stream constitutes an igniter for the main burner flame.

12. The process of claim 1, in which the auxiliary stream constitutes a stabilizer for the main burner flame.

* * * * *